US009944111B2

(12) United States Patent
Elmore

(10) Patent No.: US 9,944,111 B2
(45) Date of Patent: Apr. 17, 2018

(54) METHOD AND APPARATUS FOR EXTENDING AND RETRACTING THE WRITING ELEMENT OF A SELF-RETAINING WRITING INSTRUMENT

(71) Applicant: James Michael Elmore, Atlanta, GA (US)

(72) Inventor: James Michael Elmore, Atlanta, GA (US)

( * ) Notice: Subject to any disclaimer, the term of this patent is extended or adjusted under 35 U.S.C. 154(b) by 80 days.

(21) Appl. No.: 14/868,401

(22) Filed: Sep. 29, 2015

(65) Prior Publication Data

US 2017/0087923 A1 Mar. 30, 2017
US 2017/0305186 A9 Oct. 26, 2017

Related U.S. Application Data

(60) Provisional application No. 62/056,737, filed on Sep. 29, 2014.

(51) Int. Cl.
*B43K 24/02* (2006.01)
*B43K 7/12* (2006.01)
(Continued)

(52) U.S. Cl.
CPC ..... *B43K 24/023* (2013.01); *B43K 7/005* (2013.01); *B43K 7/12* (2013.01); *B43K 8/003* (2013.01);
(Continued)

(58) Field of Classification Search
CPC ..... B43K 24/023; B43K 7/12; B43K 8/24; B43K 19/006; B43K 8/003; B43K 23/00; B43K 7/005
(Continued)

(56) References Cited

U.S. PATENT DOCUMENTS 1,950,960 A * 3/1934 Wisser ..... B43K 29/001 33/27.02
2,266,942 A 12/1941 Wallace
(Continued)

FOREIGN PATENT DOCUMENTS

DE 102010036953 A1 1/2012

OTHER PUBLICATIONS

"Slap Pen by Lauren Schaubach", http://www.coroflot.com/laurenschaubach/Slap-Pen (4 pages) accessed Aug. 2, 2017.

*Primary Examiner* — David Walczak
(74) *Attorney, Agent, or Firm* — Eversheds Sutherland (US) LLP

(57) ABSTRACT

The method and apparatus described herein allows for the automatic retraction and extension of the writing element of a bistable self-retaining writing instrument. The method and apparatus consists of a writing element that is joined to the end of a flexible tube or material. These are inserted through a longitudinal channel formed along the outer surface of the writing instrument and are anchored only at the end opposite the writing element. When the bistable self-retaining writing instrument transitions from a coiled to straight configuration the writing element is automatically exposed. Conversely, when pushed into its coiled configuration the writing element slides back into the channel and is thereby protected. The flexible tube or material may also act as a reservoir for a writing substrate such as ink.

20 Claims, 4 Drawing Sheets

(51) Int. Cl.

| | |
|---|---|
| ***B43K 8/24*** | (2006.01) |
| ***B43K 19/00*** | (2006.01) |
| ***B43K 8/00*** | (2006.01) |
| ***B43K 23/00*** | (2006.01) |
| ***B43K 7/00*** | (2006.01) |

(52) U.S. Cl.
CPC ..... *B43K 8/24* (2013.01); *B43K 19/006* (2013.01); *B43K 23/00* (2013.01)

(58) Field of Classification Search
USPC ..... 401/99, 8
See application file for complete search history.

(56) References Cited

U.S. PATENT DOCUMENTS 2,911,950 A * 11/1959 Freeman ..... B43K 7/005 401/209
3,005,441 A * 10/1961 Glasscock ..... B43L 15/00 401/8
3,994,605 A * 11/1976 McKnight ..... B43K 7/005 401/6
4,162,754 A 7/1979 Fleming
4,227,823 A * 10/1980 Kitzerow ..... B43K 7/00 401/6
4,729,686 A * 3/1988 Ambasz ..... B43K 24/023 401/116
5,584,195 A * 12/1996 Liu ..... A44C 5/0007 401/131
6,474,892 B2 11/2002 Chao
7,108,439 B2 * 9/2006 Zhu ..... B43K 7/005 401/109
9,051,541 B2 6/2015 Elmore
9,442,578 B2 * 9/2016 Oh ..... G06F 3/03545
2003/0155389 A1 8/2003 Swartzentruber
2005/0201810 A1 * 9/2005 Zhu ..... B43K 7/005 401/6
2009/0202287 A1 8/2009 Katsanevas
2010/0258601 A1 10/2010 Thrope
2011/0236120 A1 9/2011 Rolion et al.
2012/0055278 A1 * 3/2012 Hasty ..... B43K 23/016 74/89.45
2012/0214380 A1 * 8/2012 Vine, III ..... A44C 5/0084 446/121
2013/0044215 A1 2/2013 Rothkopf et al.
2013/0266360 A1 * 10/2013 Elmore ..... B43K 8/003 401/8
2014/0035884 A1 2/2014 Oh et al.
2015/0378391 A1 * 12/2015 Huitema ..... G06F 1/163 361/679.03

* cited by examiner

METHOD AND APPARATUS FOR EXTENDING AND RETRACTING THE WRITING ELEMENT OF A SELF-RETAINING WRITING INSTRUMENT

CROSS-REFERENCE TO RELATED APPLICATIONS

The present application claims priority benefit of U.S. Provisional Application No. 62/056,737 filed Sep. 29, 2014, which is incorporated herein by reference. In addition this application is related to U.S. patent application Ser. No. 13/856,914 filed Apr. 4, 2013 now U.S. Pat. No. 9,061,541 B2 (Self-retaining writing instrument) issued Jun. 23, 2015.

FIELD

The present disclosure relates generally to writing instruments, specifically to a method and apparatus for extending and retracting the writing element of a self-retaining writing instrument.

BACKGROUND OF THE INVENTION

Writing instruments, such as pens, pencils, and styluses, are used by millions of people every day. Most writing instruments have methods for protecting the writing element in order to prevent users from unintentionally writing with them. For example, some writing instruments have caps, which are one of the simplest of current techniques. Caps fit over the ends of writing instruments to protect and cover the writing element in order prevent unintentional use and/or leaking. Other methods include spring and/or slide assisted mechanisms, which allow retraction of the writing element within the writing instrument, such as with "clicker" pens.

Current techniques to protect the writing element of writing devices are not sufficient in many instances. Caps may be cumbersome (i.e. require two hands, one to hold the pen and the other to remove the cap), may be easy to lose, and may fall off inadvertently. Spring and/or slide-assisted mechanisms may be bulky, require additional parts, be expensive, and/or interfere with the use and function of the writing instrument.

Recently, a self-retaining writing instrument was invented which includes two principal components—a bi-stable spring and a writing element. In the straight configuration, the self-retaining writing instrument is stable enough that it can be used as a typical writing utensil. Secondary to its bistable nature, this writing instrument assumes a coiled configuration when stressed appropriately allowing it to be stored around something, usually, but not exclusively, the user's wrist.

An important feature of the bistable writing instrument is that the writing element needs to be exposed for writing and protected when worn or otherwise not being used. Unfortunately, caps frequently do not stay in place, and spring and/or slide-assisted mechanisms are bulky and not ideal for use with the bistable writing instrument as these may be more costly and, more importantly, interfere with adequate coiling or function of the bistable writing instrument.

Typical writing pens exist only in one configuration and, in general, contain ink cartridges that store writing material in a reservoir that is in fluid communication with the writing tip (i.e. ballpoint). Currently available ink cartridges are also not adequate for use with a self-retaining bistable writing instrument secondary to their inherent rigidity that impedes the ability of the self-retaining bistable writing instrument from assuming its coiled configuration.

Accordingly, there remains a considerable need for an improved method and apparatus for protecting the writing element of a writing device, specifically as relates to the self-retaining bistable writing instrument.

SUMMARY

In one aspect, the method and apparatus for extending the writing element of a bistable writing instrument is provided which occurs automatically with the change in configuration of the bistable writing instrument from its coiled to straight configuration. In certain embodiments, the method and apparatus for extending the writing element of a bistable writing instrument includes a flexible tube or material that is anchored to one end or position of the writing instrument and contains an element to be extended and retracted on the opposite end. The element to be extended/retracted is typically, but not limited to a writing element. In certain embodiments, the element to be extended is a pen tip, pencil tip, stylus, or marker.

In another aspect, the method and apparatus for retracting the writing element includes a flexible tube containing ink or other marking material (i.e. ink cartridge) that is sufficiently flexible as to not interfere with the coiling of the bistable writing instrument yet non-compressible enough that, when supported within a plastic or silicone cover or channel of the writing instrument, will accommodate the stress needed for writing.

In another aspect, the method and apparatus for extending/retracting the writing element of the self-retracting bistable writing instrument utilizes the change in length that occurs on the outer side of the bistable spring as it transitions between its coiled and straight configurations. Therefore, as the bistable writing instrument is uncoiled and straightened, the writing element extends automatically. The writing element extends as a result of the increase in length along the outer aspect of the bistable writing instrument, relative to its inner aspect. In this manner, the flexible tube or material, which is anchored only at one end, is allowed to slide forward, through a channel running longitudinally along the top of the outer aspect of the bistable writing instrument, thereby allowing its extension when straightened and retraction when coiled.

In another aspect, the method and apparatus for extending the writing element of the bistable writing instrument includes a flexible material that is anchored at one end or position and courses longitudinally along the outer aspect of the bistable writing instrument. This material is flexible enough as to not interfere with the coiling and straightening of the bistable writing instrument yet has adequate compressive and tensile strength that, when supported by the cover of the bistable writing instrument, may act to appropriately extend and retract an element that may include, but is not limited to, one containing ink, one containing a material that may be useful for writing on capacitive or resistive touch screens (i.e. tablet stylus), or one containing pencil lead.

DETAILED DESCRIPTION OF THE INVENTION

The present disclosure will now be described more fully hereinafter with reference to the accompanying drawings, like numbers refer to like elements throughout the drawings.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims. Several embodiments of the method and apparatus for retracting the writing element of a self-retaining writing instrument are possible and may also be used with other materials or designs that would be obvious to those skilled in the art.

Broadly, an embodiment of the present invention provides a method for retracting and extending the writing element of a self-retaining bistable writing instrument. Retraction and extension of the writing element, as detailed and described, occurs automatically as the bi-stable spring of the writing instrument is coiled and uncoiled or straightened. The apparatus and method of the present invention obviates the need for caps or covers, as well as the need for alternative mechanisms to extend and retract the writing element.

Figures 1, 2, 3, 4, 5, 6:
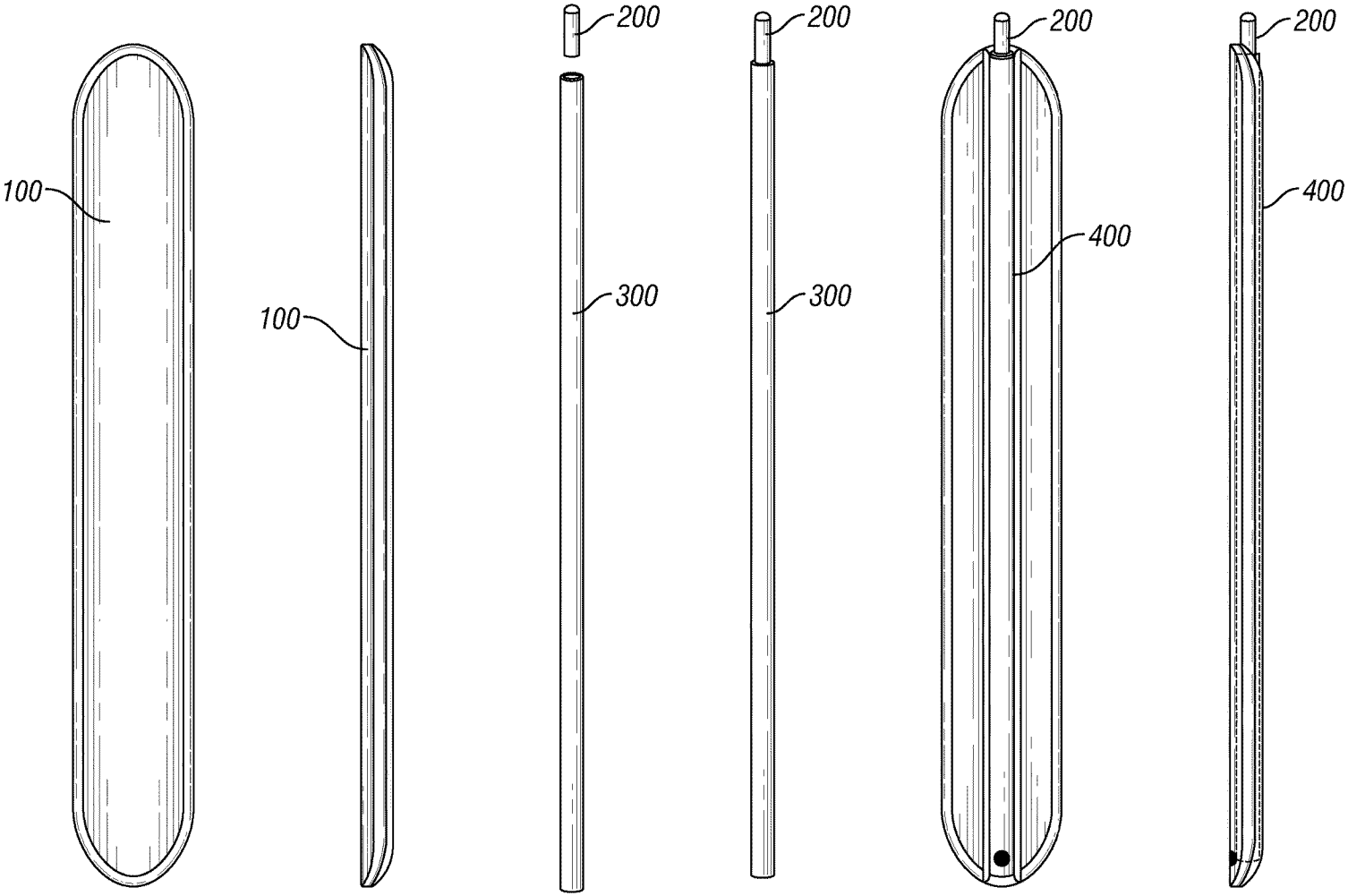
FIG. 1 is a top view of a bi-stable spring usable for forming a self-retaining bistable writing instrument (SRWI).
FIG. 2 is a side view of the bi-stable spring of FIG. 1.
FIG. 3 is an exploded view of a writing element and a flexible, less-compressible tubing or material.
FIG. 4 is an assembled view of the writing element of FIG. 3 attached to the end of the flexible, less/non-compressible tubing/material.
FIG. 5 is a top view of the automatically retracting self-retaining bistable writing device, in its straight configuration. Note that the top of the channel running the length of the writing instrument is cut away to show the flexible tube/material and that, in the straight configuration, the writing element extends beyond the end of the instrument and therefore is adequately exposed for writing.
FIG. 6 is a side view of the automatically retracting self-retaining bistable writing device of FIG. 5.
Figure 7:
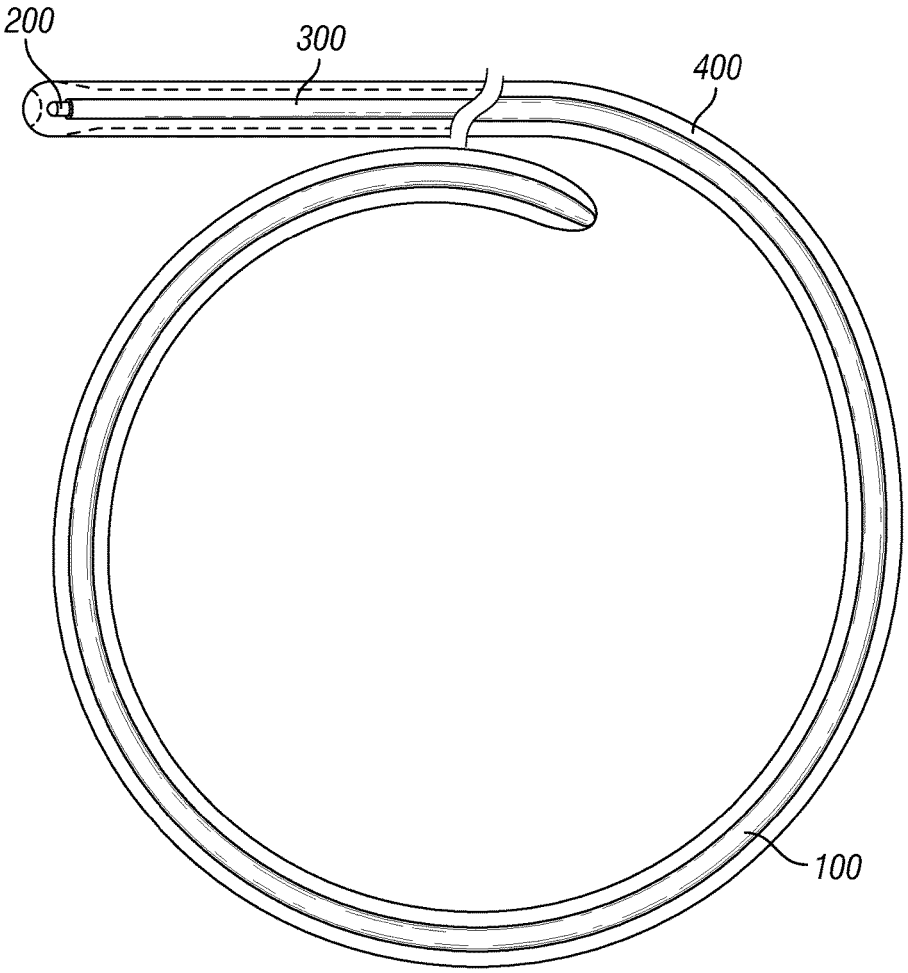
FIG. 7 is a side view of the automatically retracting self-retaining bistable writing device (SRWI) of FIG. 6 in a coiled configuration. Note that the writing element is retracted within the covering and therefore protected.

The automatically retracting and extending apparatus of the bistable writing instrument of the present invention includes four principal components: (1) a bi-stable spring 100 (FIGS. 1 and 2), (2) a writing element 200 (FIG. 2), (3) a flexible but less-compressible material or tube 300 (FIG. 4) and (4) a cover 400 of appropriate material, which acts to hold the other parts together and which may wholly or partly contain a channel/tunnel/or groove running longitudinally down the outer surface of the bistable writing instrument which supports, without binding, the writing element (2) attached to the flexible tuber or material (3).

The bi-stable spring is typically made of, but not limited to, a metal or plastic that is fashioned in such a way as to be stable in both the coiled and straight configurations. When the bi-stable spring is stressed sufficiently while in its straight configuration, it changes shapes into a circular coil.

The flexible and non-compressible material or tube may wholly or partly act as a substrate reservoir and thereby provide, by fluid communication, a substrate (typically but not limited to ink), if needed, to the writing element. The flexible and less/non-compressible material is flexible enough to conform, with minimal resistance, to both the straight and coiled configuration of the bi-stable spring; yet non-compressible enough that, with support from the covering, will remain sufficiently stable for the length-wise compressive pressures applied to it from writing.

The writing element may include, but is not limited to, a ball point pen tip, stylus, felt marker, or pencil type lead. The covering may be of any suitable material that is both sufficiently strong but also adequately flexible, typically silicone, vinyl, or fabric.

Figure 8A:
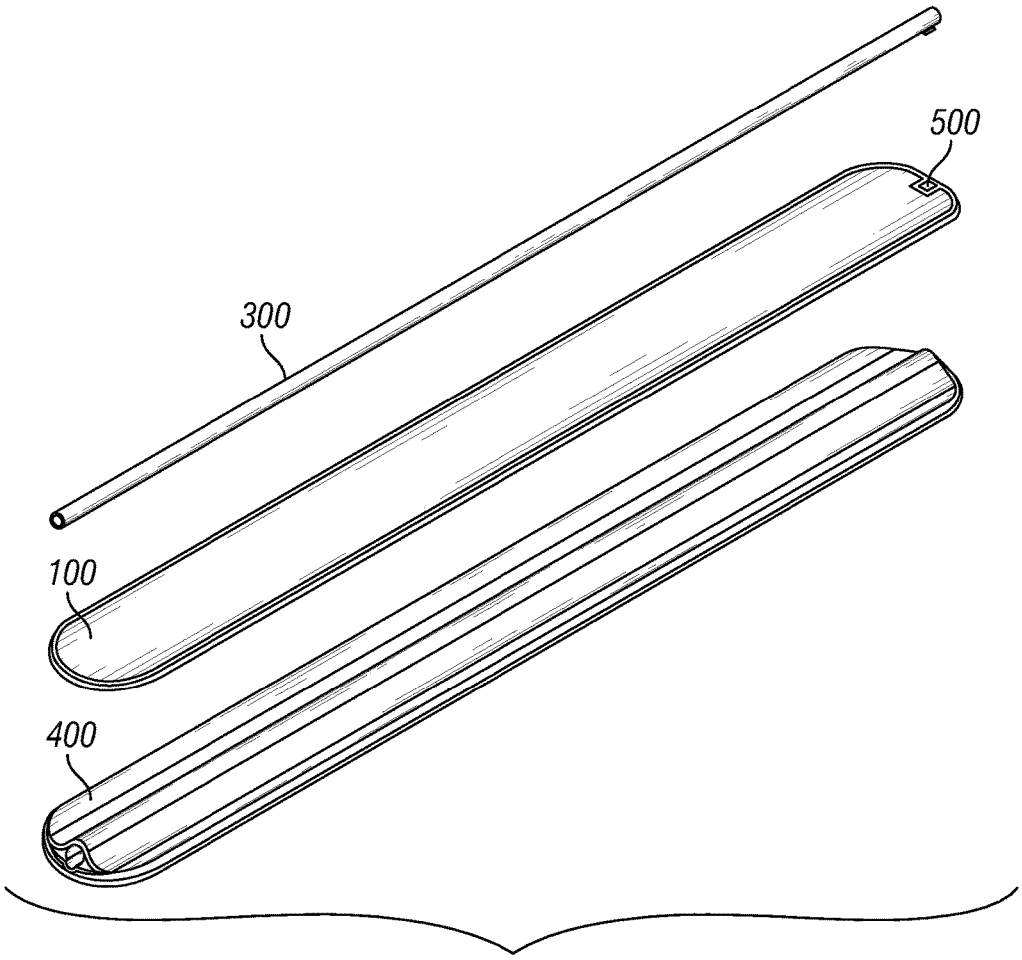
FIG. 8A is the exploded view of the automatically retracting self-retaining bistable writing device showing the principal components. Note the notch in the sheet metal base that is one method that may be used to anchor the pen tube or material at the end position of the instrument.
Figure 8B:
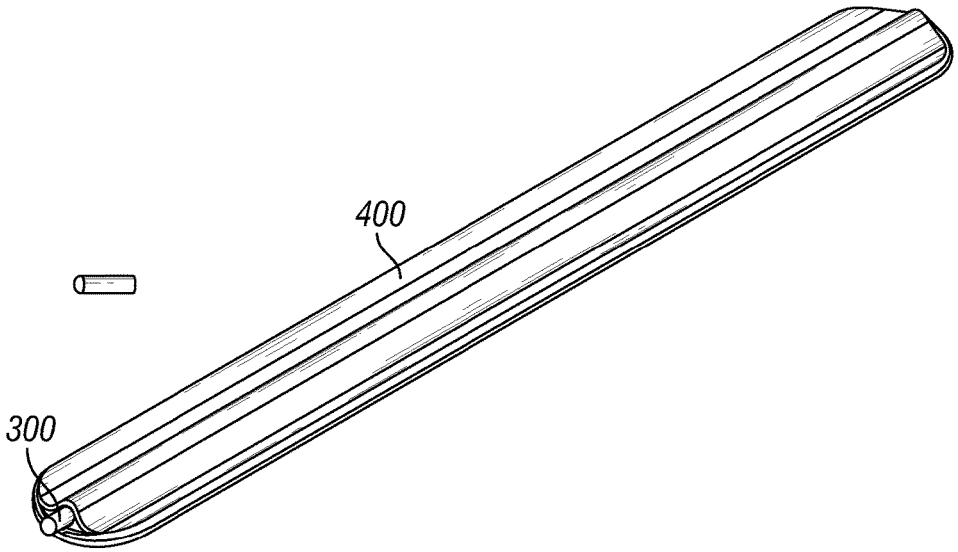
FIG. 8B is the assembled view of the automatically retracting self-retaining bistable writing device of FIG. 8A.
Figure 9A:
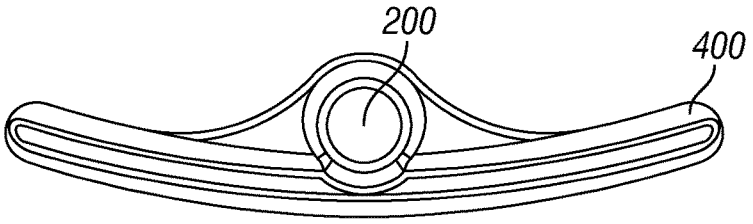
FIG. 9A is an end-on and perspective view of a first end of the automatically retracting self-retaining bistable writing device of FIG. 8B.
Figure 9B:
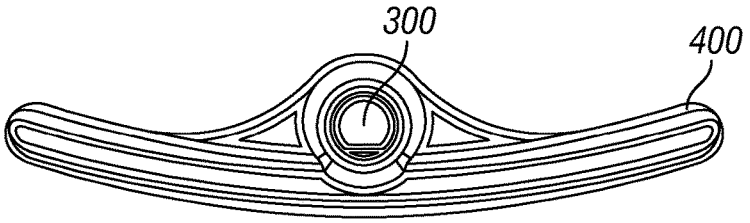
FIG. 9B is an end-on perspective view of a second end of the automatically retracting self-retaining bistable writing device of FIG. 8B.
Figure 9C:
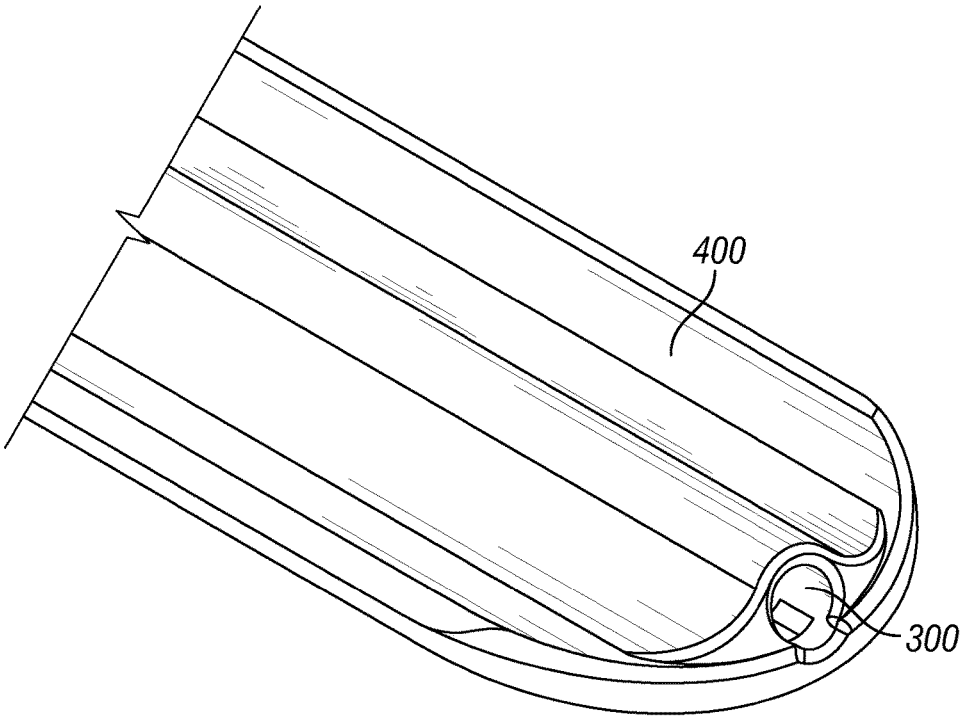
FIG. 9C is an upper perspective view of the second end of the automatically retracting self-retaining bistable writing device of FIG. 8B.

The writing element and the flexible less/non-compressible material or tube are attached or joined to one another. These may be joined by glue, heat-shrinking, or similar technique. Together these lie longitudinally on and in the mid aspect of the outer surface of the bi-stable spring in a groove or channel formed by the covering. The flexible less/non-compressible material or tube is fixed to the bi-stable spring and/or covering only at the end opposite, or otherwise sufficiently distant from, the writing element. In this manner the covering is allowed to slide over the flexible material and the writing element as the bistable spring is straightened from its coiled configuration. The flexible tube or material may be fixed to the appropriate end or position of the bistable writing instrument using any number of methods or combination of methods including, but not limited to a notch mechanism 500 (FIG. 8A), clip mechanism, glue, or heat shrinking.

When the bistable writing instrument is straight, the writing element is extended and protrudes from the cover sufficiently to allow for use (i.e. writing). When the bistable writing instrument is stressed appropriately and assumes a coiled configuration, the outer surface of the bi-stable spring, upon which lies the writing element and flexible non-compressible material or tube, lengthens relative to the inner surface. Since the flexible but non-compressible material is fixed to the bi-stable spring only at one end, the increase in length of the outer surface of the writing instrument relative to its inner surface allows the covering to slide forward over the writing element thereby protecting it from unintentional use.

The method and apparatus for extending the writing element of the self-retaining bistable writing instrument may be made using various techniques and materials. The self-retaining bistable writing instrument is currently being manufactured using existing techniques consisting of a bi-stable spring, a writing element, and a silicone cover. In order to employ the concepts of the current invention, a flexible but less/non-compressible tube or material, which may act as a reservoir for a writing substrate, could be fashioned from existing materials and joined, using existing techniques, to the writing element. The writing element and flexible tube or material would then be inserted through a channel formed longitudinally along the outer aspect of the cover of the self-retaining writing instrument and secured only at the end opposite the writing element.

The writing element and flexible tube or material may be fixed to the appropriate end or position of the writing instrument using any number of methods such as an anchor, peg and hole, notch, clip, or glue. The flexible tube or material would be made flexible enough as to not interfere with the coiling of the bistable writing instrument yet would be, when supported within the channel formed by the cover, sturdy enough to permit writing. Any number of materials may suffice for this including, but not limited to, any number of plastic or plastic-like materials. Typical and currently available ink cartridges do not suffice for this purpose as they to not possess the requisite dimensions and flexibility for use within a self-retaining writing instrument.

The non-compressible material or tube could then be wielded, glued, clipped, snapped or otherwise fixed onto only one end or adequately distant position of the writing instrument. The bi-stable spring, writing element, and non-compressible material or tube is then covered with a material including, but not limited to, silicone, which is molded or formed to provide a channel running longitudinally along the outer aspect of the writing element. In this fashion the writing element, joined to the less/non-compressible material or tube (i.e. ink cartridge), is supported, but not bound, within the channel or groove oriented longitudinally along the mid and outer aspect of the bistable writing instrument. In this fashion, the writing element joined to the flexible non-compressible tube or material, is permitted to slide freely within it and along the bi-stable spring in order to allow extension and retraction of the writing element.

It should be understood, of course, that the foregoing relates to exemplary embodiments of the invention and that modifications may be made without departing from the spirit and scope of the invention as set forth in the following claims.

What is claimed is:

1. A writing instrument comprising:

a bistable spring having a first surface and an opposed second surface, and having a first configuration in which the writing instrument is straightened and a second configuration in which the writing instrument is coiled, wherein the bistable spring is configured to assume the second configuration upon application of a sufficient stress to the bistable spring in the first configuration;

a spring cover defining a longitudinal channel therein, the spring cover comprising a flexible material disposed on the first and second surfaces of the bistable spring; and a flexible tube or material disposed in the longitudinal channel, the flexible tube or material containing a writing element configured to be extended automatically upon the bistable spring assuming the first configuration, wherein an end of the flexible tube or material distal the writing element is anchored to the bistable spring or to the spring cover, such that the flexible tube or material is freely slidable at an end containing the writing element.

2. The writing instrument of claim 1, wherein the writing element comprises a pen, stylus, marker, or pencil lead.

3. The writing instrument of claim 1, wherein the flexible tube or material comprises a reservoir for a writing substrate.

4. The writing instrument of claim 3, wherein the writing substrate comprises ink.

5. The writing instrument of claim 1, wherein the writing element is further configured to be retracted automatically upon the bistable spring assuming the second configuration.

6. The writing instrument of claim 1, wherein the flexible material of the spring cover comprises silicone, vinyl, or fabric.

7. The writing instrument of claim 1, wherein the longitudinal channel is positioned along a central aspect of the first or second surface of the bistable spring.

8. The writing instrument of claim 7, wherein the longitudinal channel has a width that is less than a width of the first or second surface of the bistable spring along which the longitudinal channel is positioned.

9. The writing instrument of claim 1, wherein the end of the flexible tube or material distal the writing element is anchored to the bistable spring or to the spring cover at an end thereof.

10. The writing instrument of claim 1, wherein the flexible tube is non-compressive such that the flexible tube remains stable when exposed to a compressive pressure associated with a user writing with the writing instrument.

11. A method for extending a writing element of a writing instrument, comprising:

applying a stress to a bistable spring of the writing instrument, the stress being sufficient to transform the bistable spring from a configuration in which the writing instrument is coiled to a configuration in which the writing instrument is straightened, wherein the bistable spring has a first surface and an opposed second surface, wherein the transformation of the writing instrument from the coiled configuration to the straightened configuration automatically causes a flexible tube or material disposed in a longitudinal channel defined by a spring cover comprising a flexible material disposed on the first and second surfaces of the bistable spring to extend from an end of the bistable spring, the flexible tube or material comprising a writing element, and wherein an end of the flexible tube or material distal the writing element is anchored to the bistable spring or to the spring cover, such that the flexible tube or material is freely slidable at an end containing the writing element.

12. The method of claim 11, wherein the writing element comprises a pen, stylus, marker, or pencil lead.

13. The method of claim 11, wherein the flexible tube or material comprises a reservoir for a writing substrate.

14. The method of claim 13, wherein the writing substrate comprises ink.

15. The method of claim 11, wherein the writing element is configured to be retracted automatically upon the bistable spring assuming the coiled configuration.

16. The method of claim 11, wherein the flexible material of the spring cover comprises silicone, vinyl, or fabric.

17. The method of claim 11, wherein the longitudinal channel is positioned along a central aspect of the first or second surface of the bistable spring.

18. The method of claim 17, wherein the longitudinal channel has a width that is less than a width of the first or second surface of the bistable spring along which the longitudinal channel is positioned.

19. The method of claim 11, wherein the end of the flexible tube or material distal the writing element is anchored to the bistable spring or cover at an end thereof.

20. The method of claim 11, wherein the flexible tube is non-compressive such that the flexible tube remains stable when exposed to a compressive pressure associated with a user writing with the writing instrument.

* * * * *